United States Patent [19]

Neubecker et al.

[11] Patent Number: 5,035,611

[45] Date of Patent: Jul. 30, 1991

[54] APPARATUS FOR CONTROLLING GAS FLOWS IN VACUUM FURNACES

[75] Inventors: Karlheinz Neubecker, Kleinostheim; Cordt Rohde, Hanau; Gerhard Welzig, Darmstadt, all of Fed. Rep. of Germany

[73] Assignee: Degussa Aktiengesellschaft, Frankfurt, Fed. Rep. of Germany

[21] Appl. No.: 501,103

[22] Filed: Mar. 29, 1990

[30] Foreign Application Priority Data

Mar. 30, 1989 [DE] Fed. Rep. of Germany ..... 3910234

[51] Int. Cl.[5] ..... F27B 3/22

[52] U.S. Cl. ..... 432/176; 432/205; 432/152; 415/157; 415/148

[58] Field of Search ..... 432/205, 152, 220, 176; 415/126, 148, 151

[56] References Cited

U.S. PATENT DOCUMENTS

| | | | |
|---|---|---|---|
| 4,135,850 | 1/1979 | d'Anjou | 415/148 |
| 4,265,592 | 5/1981 | Canlini | 415/157 |
| 4,553,404 | 11/1985 | Malchow et al. | 415/148 |
| 4,560,348 | 12/1985 | Moller | 432/205 |
| 4,596,526 | 6/1986 | Soliman | 432/205 |
| 4,643,639 | 2/1987 | Caine | 415/148 |
| 4,830,610 | 5/1989 | Hemsath | 432/152 |
| 4,836,776 | 6/1989 | Jomain | 432/176 |
| 4,854,860 | 8/1989 | Hangath | 432/5 |
| 4,859,140 | 8/1989 | Passadore | 415/157 |
| 4,891,008 | 1/1990 | Hemsath | 432/152 |
| 4,906,182 | 3/1990 | Moller | 432/176 |

*Primary Examiner*—Henry C. Yuen
*Attorney, Agent, or Firm*—Beveridge, DeGrandi & Weilacher

[57] ABSTRACT

Two concentric and relatively displaceable cylinders mounted on the center axis of a vacuum furnace between its load chamber and its blower serve to control the gas flows in said furnace, where said gas flows are used to heat and cool the load portions.

1 Claim, 2 Drawing Sheets

APPARATUS FOR CONTROLLING GAS FLOWS IN VACUUM FURNACES

INTRODUCTION AND BACKGROUND

The present invention relates to apparatus with which to control gas flows in vacuum furnaces, wherein the contents of the furnace are heated as well as cooled in a charge chamber, by means of a blower and gas circulation. Temperatures of up to about 750° C. are contemplated in such furnaces.

As a rule such furnaces are composed of a cylindrical pressure-resistant housing capable of holding a heated load chamber therein enclosed by thermal insulation, together with a heat exchanger and a blower to circulate the heating and cooling gas. Advantageously during both the operational stage wherein the load is heated convectively and for the cooling cycle, the gas is guided through pipes into the load or work chamber, where said pipes act as heating elements. The pipes are mounted axially with respect to the surface of the cylindrical load chamber and are provided with nozzles pointing at the load. Further advantageously, the gas is conducted in such a way as to circulate during both operational stages by the same blower. A typical furnace is described in the German patent 37 36 502.

To make certain that the same gas may both heat and cool the contents of the chamber, the furnace requires a control system which allows switching the gas flow circulated by the blower between two circuits. In one circuit, the gas will circulate only within the furnace region equipped with thermal insulation; in the other circuit it will be guided over the heat-exchange pipes located between the thermal insulation and the receptacle wall.

In the furnace described in German patent 37 36 502, this problem is solved by integrating a box between the load chamber and the suction side of the blower inserted into a gas manifold device. The box is equipped with apertures both toward the load chamber and toward the annular space between the thermal insulation and the receptacle wall wherein the heat-exchange pipes are mounted. This box houses a slider means which can be displaced by a piston rod transversely to the furnace axis. Depending on the slider position, the apertures toward the load chamber or the annular space between the thermal insulation and receptacle wall are cleared, and the particular other apertures are simultaneously closed.

This design incurs the drawback that the slider can seal only apertures of small cross-sections, whereby high pressure losses follow when the gases flow through them. Moreover the flow to the blower takes place asymmetrically and as a result the gas flow is unevenly spread over the heating pipes. Another drawback is that the slider course between the two end positions is very long. Its actuation requires a very long cylinder which projects from the furnace housing and thereby restricts the applicabilities of such furnaces.

SUMMARY OF THE INVENTION

Accordingly it is an object of the present invention to provide apparatus for controlling gas flows in vacuum furnaces wherein the loads are both heated and cooled by circulating gases in a load chamber. This apparatus makes it possible to alternatively connect the blower suction side to the load chamber only or to the annular space between the thermal insulation and the receptacle wall which houses the heat-exchanger pipes as well. The inflow of the gases takes place in wholly symmetrical manner, only minor flow losses may arise, and the actuator courses must be small.

In carrying out the invention, a feature resides in mounting two concentric and relatively displaceable cylinders between the load chamber and the blower on the central axis of the furnace, the outer cylinder being rigidly mounted to the load chamber and the inner cylinder being axially displaceable by means of link system between a recoil plate mounted in the load chamber and the blower suction-aperture.

DETAILED DESCRIPTION OF THE INVENTION

Figure 1:
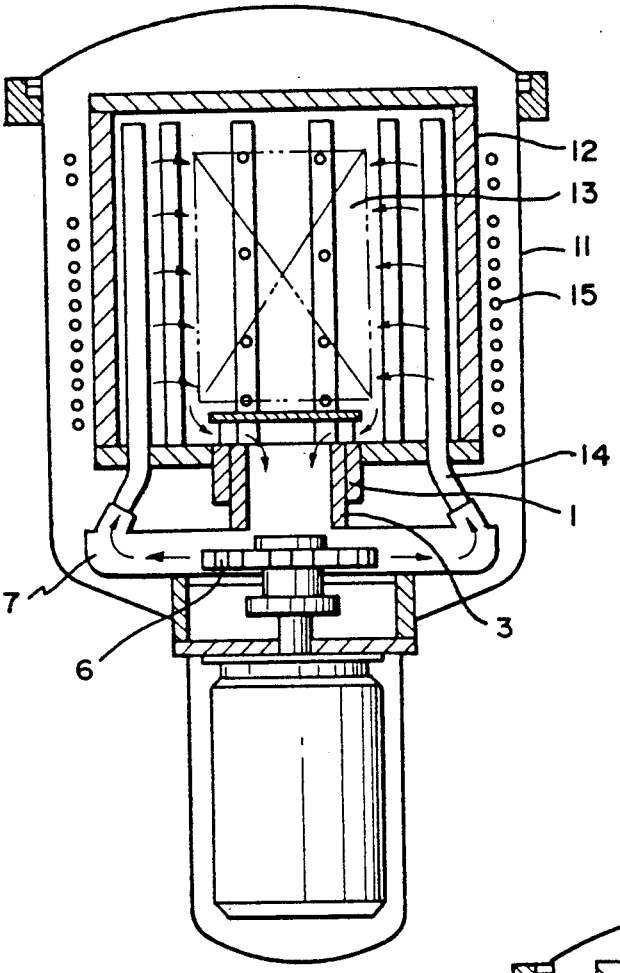
FIGS. 1 through 4 schematically show an illustrative embodiment of the control system of the invention, with FIGS. 1 and 2 displaying it in the two end positions, extended and retracted, in a vacuum furnace of the type shown in the German patent 37 36 502 and FIGS. 3 and 4 displaying these end positions on an enlarged scale.
Figure 2:
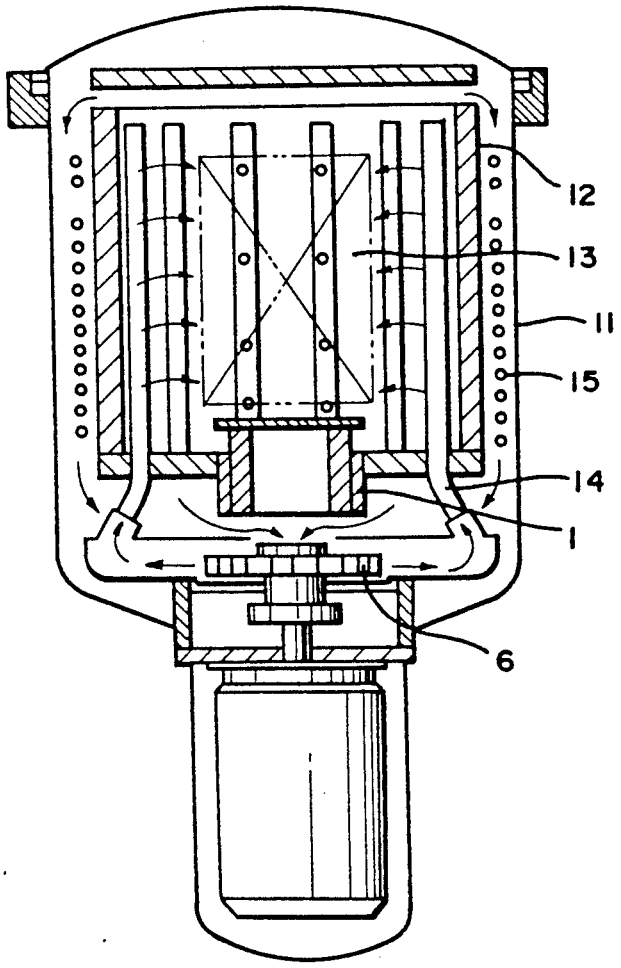

The furnace consists of a receptacle 11 housing a load chamber 13 enclosed by thermal insulation 12. The load chamber is capable of being simultaneously heated by heat pipes 14 and supplied with gas. The heat exchanger 15 is located between the inner wall of the receptacle 11 and the thermal insulation 12.

The control system consists of two concentric cylinders, of which the outer one 1 is rigidly joined to the wall 2 of the load chamber 13 that faces the blower 6. This load chamber serves as a guide for the inner cylinder 3 fitted with slight play into the outer cylinder 1. The inner cylinder 3 can be displaced by means of a link system between the impact plate 5 mounted in the load chamber 13 by stud bolts 4 to the load-chamber wall 2 and the wall of a gas manifold 7 enclosing the blower 6. Preferably operation is such that one shaft 8 is introduced transversely to the center axis of the furnace into the receptacle. A toggle fork is 9 mounted thereto and acts on a rod 10 passing transversely through the inner cylinder 3 to which it is rigidly joined. To allow displacing the inner cylinder 3 by means of this rod 10, longitudinal slots are present in the outer, stationary cylinder 1. By rotating the shaft 8 by a few degrees, the displaceable cylinder can therefore be moved into the end positions shown in FIGS. 3 and 4.

Figure 3:
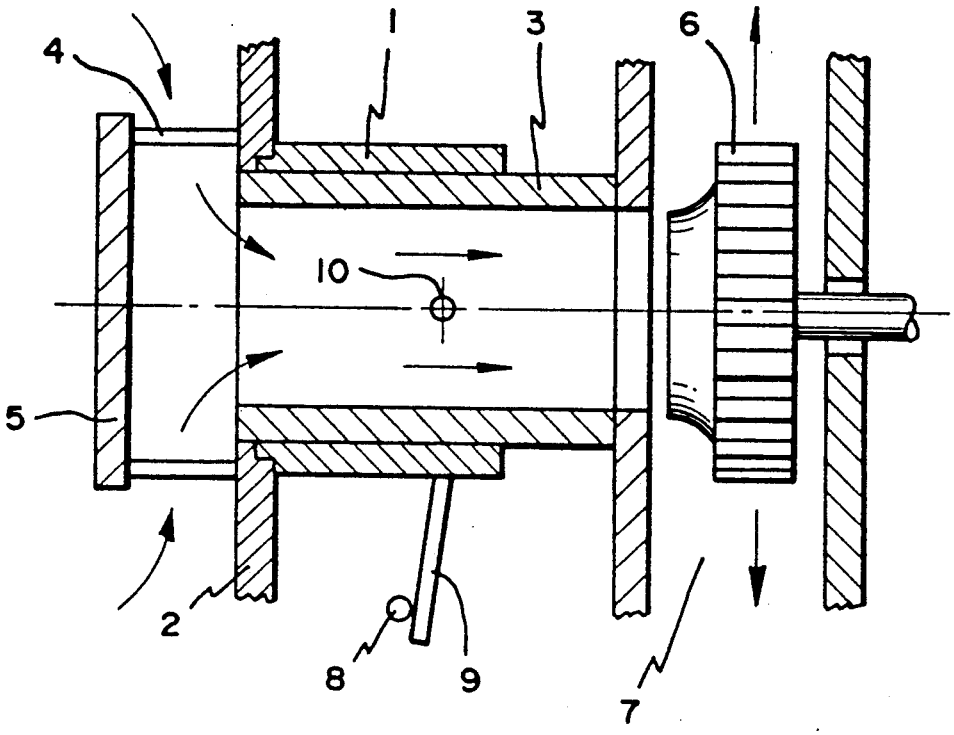

In the position shown in FIG. 3, the inner cylinder 3 rests by its end face against the gas manifold 7 and thereby seals the open space outside the thermal insulation from the blower suction aperture. At the same time, an annular inflow cross-section between the impact plate 5 and the load-chamber wall 2 is made accessible. Accordingly the blower 6 pulls the gas from the load chamber 12 through the free cross-section of the inner cylinder 3.

Figure 4:
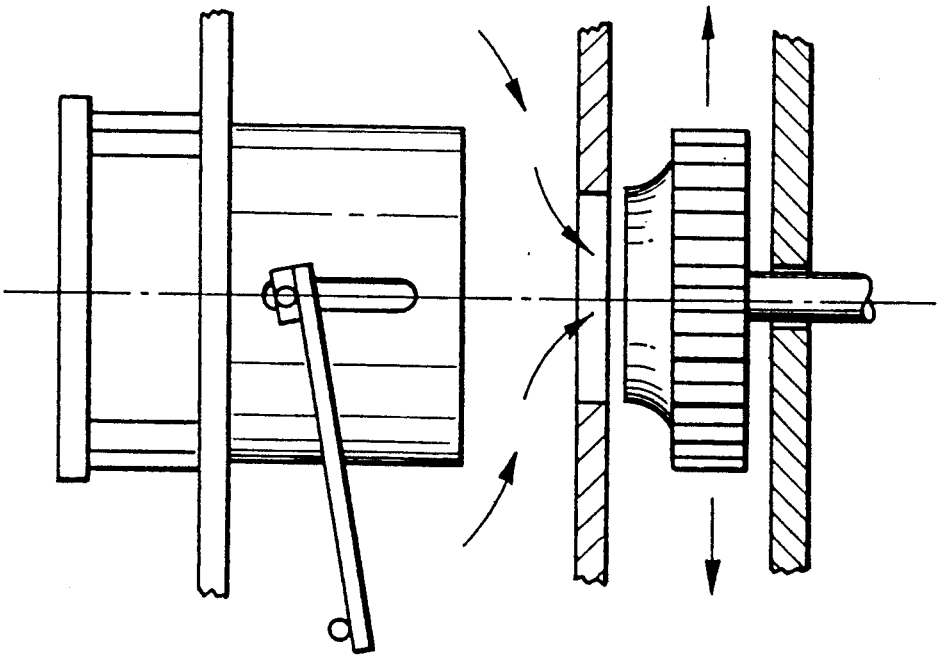

In the position shown in FIG. 4, the inner cylinder 3 rests by its second end face against the impact plate 5 and seals the load chamber 13. An annular inflow cross-section to the furnace chamber outside the thermal insulation is made accessible at the blower suction aperture.

The two cylinders 1 and 3 preferably are made of rigid carbon bonded carbon fiber insulation material (rigid graphite felt) which is coated on all sides with graphite foil. This material is resistant to all applicable temperatures. Because of the low weight and low friction of the graphite/graphite match, the driving forces necessary to move the cylinders are small.

Because of the annular inflow cross-sections, the inflow to the blower 6 in both operational stages is designed to be wholly radially symmetric. By suitably matching the height of the annular gap to the suction cross-section of the blower 6, the flow losses can be minimized. The drive required to rotate the shaft 8 illustratively may be implemented by a compact pivoting actuator which in no way restricts furnace set-up.

Further variations and modifications of the foregoing device will be apparent to those skilled in the art and are intended to be encompassed by the claim appended hereto.

German priority application P 39 10 234.3 is relied on and incorporated herein.

We claim:

1. Apparatus for controlling gas flows in vacuum furnaces wherein the loads are both heated and chilled in a load chamber by means of a gas-recirculating blower, comprising a furnace receptacle (11), a load chamber (13) located within said receptacle, and a blower (6) arranged on the center axis of said receptacle (11) and having a suction aperture, two relatively displaceable cylinders (1, 3) mounted between the load chamber (13) and the blower (6) on the center axis of the furnace, an impact plate (5) mounted on said load chamber (13) where the outer cylinder (1) is rigidly joined to said load chamber (13) and where the inner cylinder (3) can be moved axially, a link system including a shaft (8), a toggle fork (9) and a rod (10) located between said impact plate (5) mounted on said load chamber (13) and the blower suction aperture, said link system being connected to said inner cylinder (3) and passing through an opening in said outer cylinder (1).

* * * * *